US012416297B2

(12) United States Patent
Hou et al.

(10) Patent No.: US 12,416,297 B2
(45) Date of Patent: Sep. 16, 2025

(54) LOW-FLOW AND DOUBLE-OUTLET ELECTROMAGNETIC PLUNGER PUMP

(71) Applicant: Sichuan Aerospace Shiyuan Technology Co., Ltd., Sichuan (CN)

(72) Inventors: Rong Hou, Sichuan (CN); Yi Pu, Sichuan (CN); Lianshan Chen, Sichuan (CN); Shengqiu Duan, Sichuan (CN); Wenqiang Hu, Sichuan (CN); Yinlong Jiang, Sichuan (CN)

(73) Assignee: Sichuan Aerospace Shiyuan Technology Co., Ltd., Chengdu (CN)

( * ) Notice: Subject to any disclaimer, the term of this patent is extended or adjusted under 35 U.S.C. 154(b) by 125 days.

(21) Appl. No.: 18/393,781

(22) Filed: Dec. 22, 2023

(65) Prior Publication Data

US 2025/0146480 A1 May 8, 2025

(30) Foreign Application Priority Data

Nov. 7, 2023 (CN) ..... 202311467387.7

(51) Int. Cl.
*F04B 17/03* (2006.01)
*F04B 49/08* (2006.01)

(52) U.S. Cl.
CPC ..... *F04B 17/03* (2013.01); *F04B 49/08* (2013.01)

(58) Field of Classification Search
CPC .... F01M 2001/023; F01M 1/02; F02M 51/04; B60G 2500/02
See application file for complete search history.

(56) References Cited

U.S. PATENT DOCUMENTS 6,398,511 B1 * 6/2002 French ..... F04B 17/042 417/415
2021/0363951 A1 * 11/2021 Revidat ..... F04B 17/03

FOREIGN PATENT DOCUMENTS

WO WO-2014066696 A9 * 10/2014 ..... F02D 41/30

* cited by examiner

*Primary Examiner* — Anthony Ayala Delgado

(57) ABSTRACT

Disclosed is a low-flow and double-outlet electromagnetic plunger pump, including a balance disk. A pump cavity is arranged in a pump body, a pressure control assembly is hermetically and fixedly arranged on an outlet port, an end portion of an overflow pipe is hermetically and fixedly arranged on an inlet port, an interior of the overflow pipe is hermetically and fixedly arranged with an overflow grid, and anti-backflow assemblies are hermetically and fixedly arranged on outlets of oil filling channels. By controlling the movement of plunger pipes or multi-plunger pipes through the balance disk, the double-outlet or multi-outlet flow can be formed to simplify a pipeline mechanism for supplying oil to a multi-cylinder or multi-system and reduce the cost; and the double-outlet flow has good consistency, improving the stability of the system.

10 Claims, 5 Drawing Sheets

LOW-FLOW AND DOUBLE-OUTLET ELECTROMAGNETIC PLUNGER PUMP

CROSS-REFERENCE TO RELATED APPLICATIONS

This application claims priority of Chinese Patent Application No. 202311467387.7, filed on Nov. 7, 2023, the entire contents of which are incorporated herein by reference.

TECHNICAL FIELD

The present disclosure relates to the technical field of electromagnetic plunger pumps, in particular to a low-flow and double-outlet electromagnetic plunger pump.

BACKGROUND

A plunger pump is a hydraulic pump that uses a plunger to make a reciprocating movement in a cylinder body to change a sealing volume to achieve oil suction and oil pumping. Due to the high pressure, compact structure, high efficiency and convenient flow adjustment, plunger pumps are widely used in high pressure, high flow and high power systems and flow adjustment applications, such as engines, aircraft, ships, broaching machines, hydraulic machines, engineering machinery and mining metallurgical machinery. At present, such electromagnetic plunger pumps are mainly single-channel, in the multi-cylinder small engine lubrication system or engine ignition device, multiple single-channel electromagnetic plunger pumps are used to build a pipeline system to meet the engine lubrication or ignition flow requirements, and the engine resource requirements can be reduced through the double-channel or multi-channel output structure plunger pumps, the pipeline layout having a simple structure and high reliability; and such electromagnetic plunger pumps are subject to weak inlet pressure variation, if the inlet pressure fluctuation is too high, an outlet check valve will break down, resulting in the failure of electromagnetic plunger pumps. Therefore, other pipelines and valves are needed to keep the inlet pressure of electromagnetic plunger pump stable, and the pipelines have complex structures and large occupied space.

SUMMARY

An object of the present disclosure is to provide a low-flow and double-outlet electromagnetic plunger pump to overcome the deficiencies of the prior art.

The object of the present disclosure is achieved by the following technical solutions.

A low-flow and double-outlet electromagnetic plunger pump includes a pump body, a pump cover, a balance disk, a jacking spring, plunger pipes, plunger seats, plunger springs, plunger sleeves, plunger balls, plunger seal rings, an overflow pipe, an overflow grid, an electromagnetic assembly, a pressure control assembly and anti-backflow assemblies. A pump cavity is arranged in the pump body, the pump cover is fixedly arranged on the pump body and is hermetically fitted with the pump cavity, and an inlet port and an outlet port penetrate through and are arranged on a side wall of the pump cavity. The inlet port is arranged opposite to the outlet port, the pressure control assembly is hermetically and fixedly arranged on the outlet port, and an end portion of the overflow pipe is hermetically and fixedly arranged on the inlet port. An interior of the overflow pipe is hermetically and fixedly arranged with an overflow grid, the interior of the overflow pipe is arranged with a narrow-neck channel, and the narrow-neck channel is arranged between the overflow grid and the pump cavity. The balance disk is slidably arranged in the pump cavity and cooperates with an inner wall of the pump cavity, the electromagnetic assembly is hermetically and fixedly arranged on the pump cover and is configured to drive the balance disk to slide, a lug boss cooperating with an end surface of the balance disk is hermetically and fixedly arranged at a middle position of a bottom of the pump cavity, and a first blind hole is arranged on the lug boss. One end of the jacking spring is arranged in the first blind hole, the other end of the jacking spring is in contact with the balance disk, several balance channels penetrate through and are arranged on the balance disk, and two oil filling channels parallel to a moving direction of the balance disk are arranged on the bottom of the pump cavity. The anti-backflow assemblies are hermetically and fixedly arranged on outlets of the oil filling channels, one end of the plunger pipe is slidably arranged in the oil filling channel and cooperates with the oil filling channel, and the plunger seal rings are arranged between an inner wall of the oil filling channel and an outer wall of the plunger pipe. The other end of the plunger pipe is fixedly arranged in the balance disk, and an oil passing channel is arranged in the plunger pipe. One end of the oil passing channel is communicated with the oil filling channel, the other end of the oil passing channel is communicated with the pump cavity, and the plunger seat is fixedly arranged in the oil passing channel. One end of the plunger spring is arranged on the plunger seat, and the other end of the plunger spring is in contact with the plunger ball slidably arranged in the oil passing channel. The plunger ball is hermetically fitted with an end portion of the plunger sleeve, the plunger sleeve is hermetically and fixedly arranged on an inner wall of the oil passing channel and is arranged close to a side of the pump cavity, a first through-hole penetrates through and is arranged in the plunger sleeve, and a second through-hole penetrates through and is arranged on the plunger seat.

Further, a guide rod is fixedly arranged at a middle part of the balance disk, one end of the guide rod is arranged in the first blind hole and cooperates with the first blind hole, an end portion of the guide rod is arranged with a second blind hole, an end portion of the jacking spring is arranged in the second blind hole, several pressure relief holes penetrate through and are arranged on a side wall of a bottom of the second blind hole, and the other end of the guide rod is fixedly connected to the electromagnetic assembly.

Further, a wear-resistant bushing is arranged between an inner wall of the first blind hole and an outer wall of the guide rod.

Further, the plunger seal rings are fixed on the oil filling channel via a pressing plate.

Further, the pressure control assembly includes a pressure control pipe, a pressure spring, a pressure end head and a first adjusting inner sleeve; one end of the pressure control pipe is hermetically and fixedly connected to the outlet port, and a first stepped hole penetrates through and is arranged in the pressure control pipe; one end of the pressure spring is fixedly arranged at a bottom of the first stepped hole, and the other end of the pressure spring is pressed against and slidably arranged on the pressure end head in the first stepped hole; and the pressure end head is hermetically fitted with an end portion of the first adjusting inner sleeve, the first adjusting inner sleeve is hermetically and fixedly arranged on an inner wall of the first stepped hole and is arranged close to a side of the outlet port, and a first adjusting hole penetrates through and is arranged in the first adjusting inner sleeve.

Further, the anti-backflow assemblies include anti-backflow control pipes, anti-backflow springs, anti-backflow end heads and second adjusting inner sleeves; one end of the anti-backflow control pipe is hermetically and fixedly connected to the oil filling channel, and a second stepped hole penetrates through and is arranged in the anti-backflow control pipe; one end of the anti-backflow spring is fixedly arranged at a bottom of the second stepped hole, and the other end of the anti-backflow spring is pressed against and slidably arranged on the anti-backflow end head in the second stepped hole; and the anti-backflow end head is hermetically fitted with an end portion of the second adjusting inner sleeve, the second adjusting inner sleeve is hermetically and fixedly arranged on an inner wall of the second stepped hole and is arranged close to a side of the oil filling channel, and a second adjusting hole penetrates through and is arranged in the second adjusting inner sleeve.

Further, pump seal rings are arranged between the pump body and the pump cover and arranged at an outer side of the pump cavity.

Further, the electromagnetic assembly includes a coil, an iron core, a push rod and a reset spring; and the pump cover is hermetically arranged with a movable cavity, the coil is fixedly arranged on an inner wall of the movable cavity, the iron core is slidably arranged in the coil, one end of the iron core is fixedly connected to an end portion of the guide rod via the push rod, and the iron core is fixedly connected to the inner wall of the movable cavity via the reset spring.

Further, cross sections of the inlet port and the outlet port are circular and coaxially arranged, and a cross section of the guide rod is circular; and an axial center line of the inlet port intersects an axial center line of the guide rod, the two oil filling channels are symmetrically arranged at two sides of the lug boss, and the plane where axial center lines of the two oil filling channels lie is perpendicular to the axial center line of the inlet port.

Further, an axial center line of the guide rod, a center line of the push rod, a center line of the jacking spring and a center line of the reset spring are in the same straight line.

The present disclosure has the following beneficial effects.

1) In the technical solution, by controlling the movement of the plunger pipe or multi-plunger pipe through the balance disk, the double-outlet or multi-outlet flow can be formed to simplify a pipeline mechanism for supplying oil to a multi-cylinder or multi-system and reduce resource requirements and cost; and the double-outlet flow has good consistency, improving the stability of the system. Through the design of connecting a double-plunger pipe or a multi-plunger pipe to the balance disk, the displacement of plunger pump can be increased at the same volume, further making the plunger pump yield oil independently, and supplying oil independently for different positions of the engine.
2) In the technical solution, the problems of excessive pressure at the inlet of the plunger pump and preventing the plunger pump from being damaged are effectively solved by the design of the overflow pipe and the narrow-neck channel, and the pressure control assembly is arranged for controlling the pressure of the pump cavity within the design range, particularly enabling to adapt to the complicated working conditions where the pressure fluctuation at the inlet of the pump is large.

Figure 1:
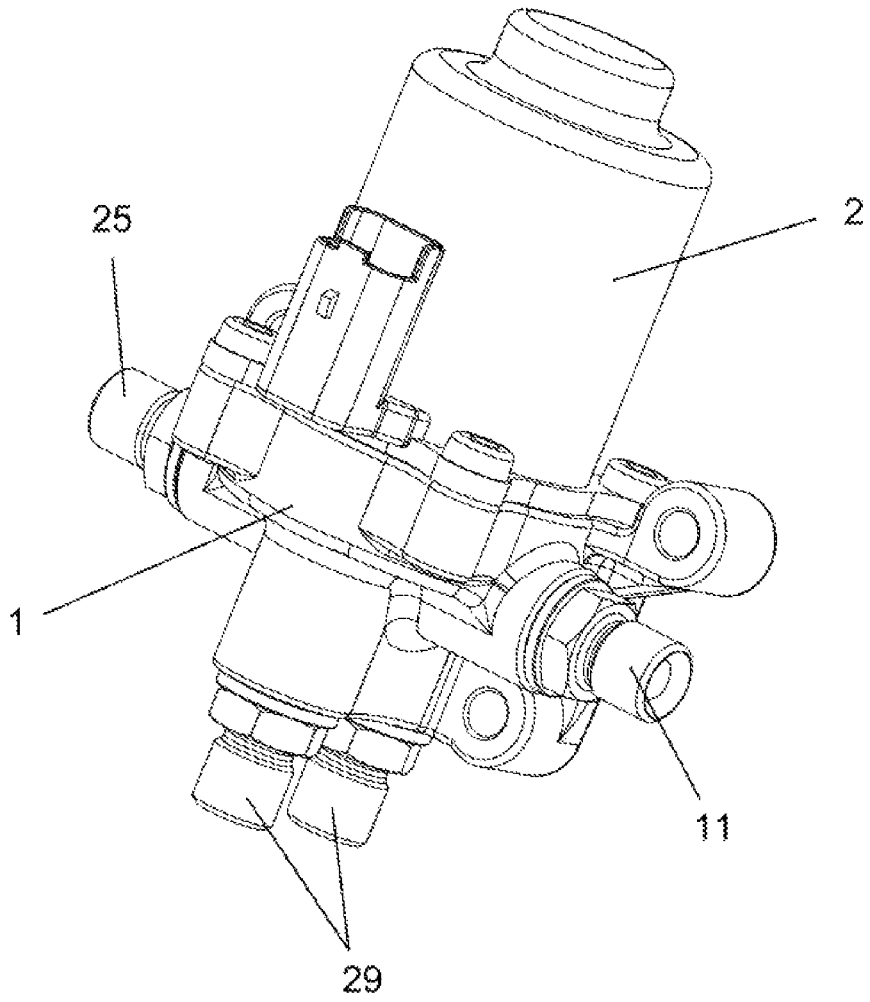
FIG. 1 is a perspective structural view of an electromagnetic plunger pump.

Reference numerals and denotations thereof: 1—pump body 2—pump cover, 3—balance disk, 4—jacking spring, 5—plunger pipe, 6—plunger seat, 7—plunger spring, 8—plunger sleeve, 9—plunger ball, 10—plunger seal ring, 11—overflow pipe, 12—overflow grid, 13—pump cavity, 14—inlet port, 15—outlet port, 16—narrow-neck channel, 17—lug boss, 18—balance channel, 19—oil filling channel, 20—oil passing channel, 21—guide rod, 22—pressure relief hole, 23—wear-resistant bushing, 24—pressing plate, 25—pressure control pipe, 26—pressure spring, 27—pressure end head, 28—first adjusting inner sleeve, 29—anti-backflow control pipe, 30—anti-backflow spring, 31—anti-backflow end head, 32—second adjusting inner sleeve, 33—pump seal ring, 34—coil, 35—iron core, 36—push rod, 37—reset spring, and 38—movable cavity.

DETAILED DESCRIPTION

Technical solutions of the present disclosure will be described clearly and completely in the following with reference to examples. Obviously, the described examples are only some, rather than all examples of the present disclosure. Based on the examples in the present disclosure, all other examples obtained by those skilled in the art without creative efforts belong to the scope of protection of the present disclosure.

Figure 2:
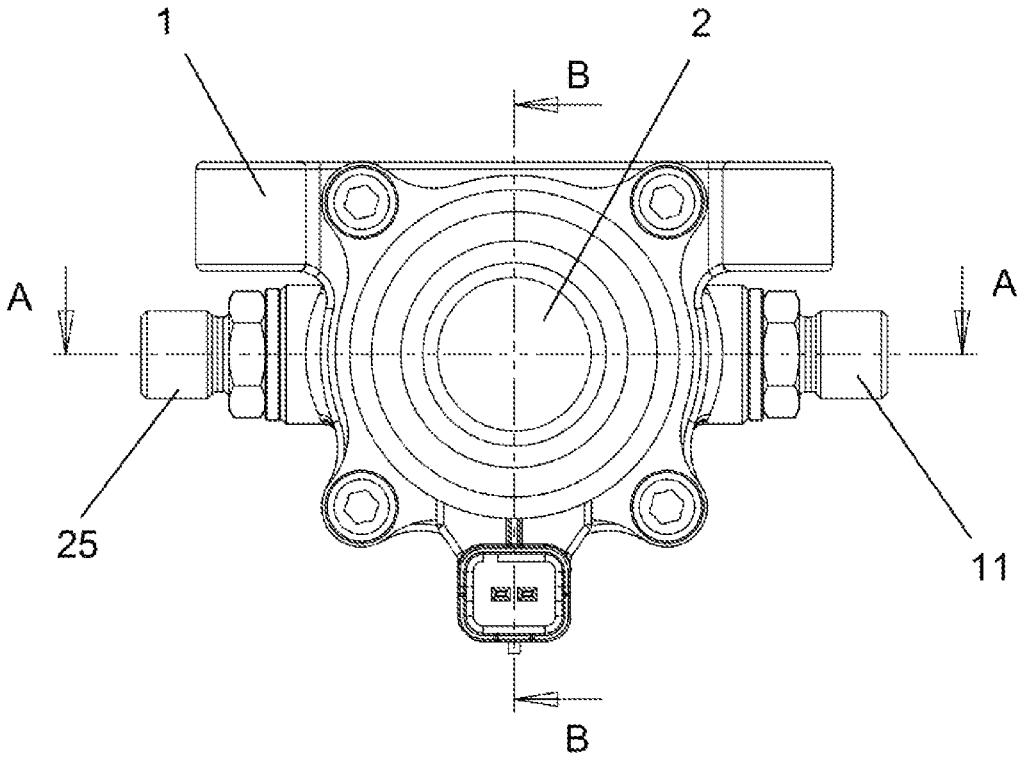
FIG. 2 is a top view of the electromagnetic plunger pump.
Figure 3:
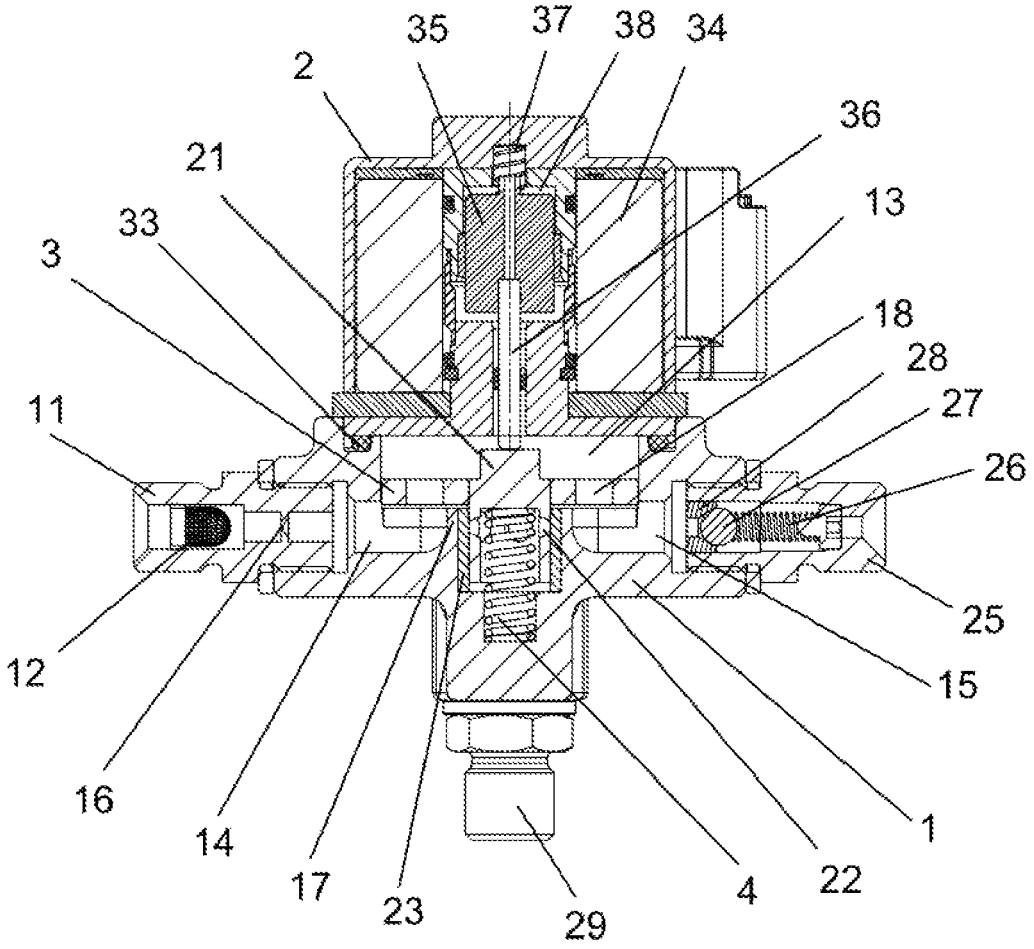
FIG. 3 is a cross-sectional view taken along the line A-A of the electromagnetic plunger pump.
Figure 4:
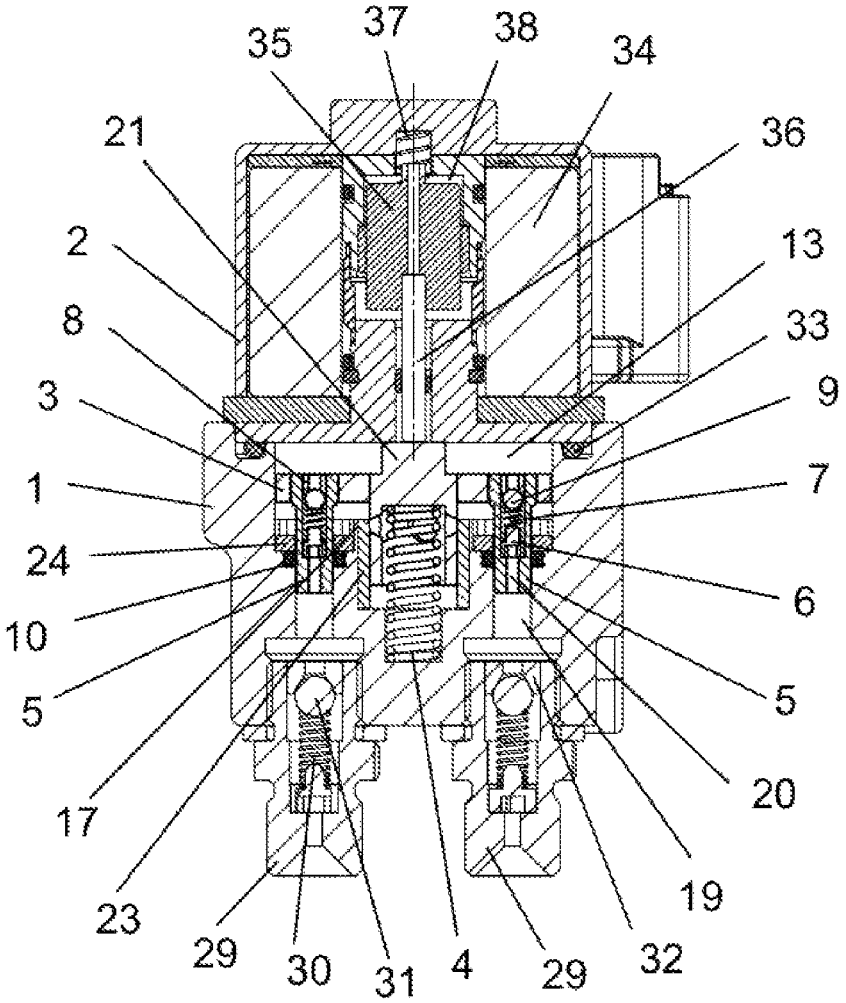
FIG. 4 is a cross-sectional view taken along the line B-B of an electromagnetic assembly in the electromagnetic plunger pump without operation.
Figure 5:
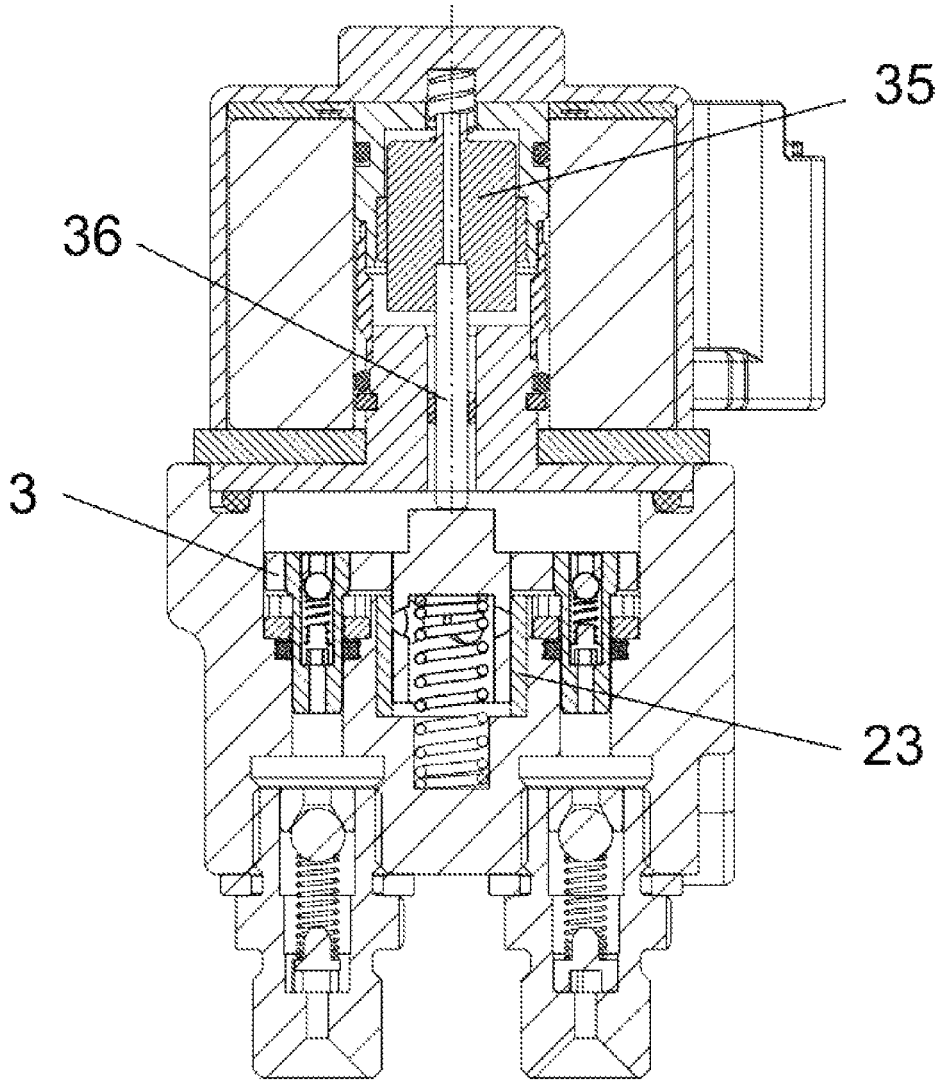
FIG. 5 is a cross-sectional view of the electromagnetic assembly in the electromagnetic plunger pump during operation.

Referring to FIGS. 1-5, the present disclosure provides the following technical solutions.

A low-flow and double-outlet electromagnetic plunger pump includes a pump body 1, a pump cover 2, a balance disk 3, a jacking spring 4, plunger pipes 5, plunger seats 6, plunger springs 7, plunger sleeves 8, plunger balls 9, plunger seal rings 10, an overflow pipe 11, an overflow grid 12, an electromagnetic assembly, a pressure control assembly and anti-backflow assemblies. A pump cavity 13 is arranged in the pump body 1, the pump cover 2 is fixedly arranged on the pump body 1 and is hermetically fitted with the pump cavity 13, and an inlet port 14 and an outlet port 15 penetrate through and are arranged on a side wall of the pump cavity 13. The inlet port 14 is arranged opposite to the outlet port 15, the pressure control assembly is hermetically and fixedly arranged on the outlet port 15, and an end portion of the overflow pipe 11 is hermetically and fixedly arranged on the inlet port 14. An interior of the overflow pipe 11 is hermetically and fixedly arranged with an overflow grid 12, the interior of the overflow pipe 11 is arranged with a narrow-neck channel 16, and the narrow-neck channel 16 is arranged between the overflow grid 12 and the pump cavity 13. The balance disk 3 is slidably arranged in the pump cavity 13 and cooperates with an inner wall of the pump cavity 13, the electromagnetic assembly is hermetically and fixedly arranged on the pump cover 2 and is configured to drive the balance disk 3 to slide, a lug boss 17 cooperating with an end surface of the balance disk 3 is hermetically and fixedly arranged at a middle position of a bottom of the pump cavity 13, and a first blind hole is arranged on the lug boss 17. One end of the jacking spring 4 is arranged in the first blind hole, the other end of the jacking spring 4 is in contact with the balance disk 3, several balance channels 18 penetrate through and are arranged on the balance disk 3, and two oil filling channels 19 parallel to a moving direction of the balance disk 3 are arranged on the bottom of the pump cavity 13. The anti-backflow assemblies are hermetically and fixedly arranged on outlets of the oil filling channels 19, one end of the plunger pipe 5 is slidably arranged in the oil filling channel 19 and cooperates with the oil filling channel 19, and the plunger seal rings 10 are arranged between an inner wall of the oil filling channel 19 and an outer wall of the plunger pipe 5. The other end of the plunger pipe 5 is fixedly arranged in the balance disk 3, and an oil passing channel 20 is arranged in the plunger pipe 5. One end of the oil passing channel 20 is communicated with the oil filling channel 19, the other end of the oil passing channel 20 is communicated with the pump cavity 13, and the plunger seat 6 is fixedly arranged in the oil passing channel 20. One end of the plunger spring 7 is arranged on the plunger seat 6, and the other end of the plunger spring 7 is in contact with the plunger ball 9 slidably arranged in the oil passing channel 20. The plunger ball 9 is hermetically fitted with an end portion of the plunger sleeve 8, the plunger sleeve 8 is hermetically and fixedly arranged on an inner wall of the oil passing channel 20 and is arranged close to a side of the pump cavity 13, a first through-hole penetrates through and is arranged in the plunger sleeve 8, and a second through-hole penetrates through and is arranged on the plunger seat 6. The plunger seal rings 10 are fixed on the oil filling channel 19 via a pressing plate 24. Pump seal rings 33 are arranged between the pump body 1 and the pump cover 2 and arranged at an outer side of the pump cavity 13. An output end of the overflow pipe 11 is threadedly and hermetically fitted with the inlet port 14, and an input end of the overflow pipe 11 is communicated with a fuel tank. The pump body 1 is connected to the pump cover 2 via bolts, and the pump seal rings 33 are arranged for better sealing of the pump cavity 13. The pressing plate 24 is arranged for facilitating the fixing of the plunger seal rings 10 against leakage between the oil filling channels 19 and the plunger pipes 5. The function of the electromagnetic assembly is to provide power for the movement of the balance disk 3; the pressure control assembly is arranged for controlling the pressure of the pump cavity 13; when the pressure in the pump cavity 13 exceeds a preset value, the pressure control assembly will open so that the pressure in the pump cavity 13 does not exceed the preset value; and the anti-backflow assemblies are arranged for preventing the medium discharged from the anti-backflow assemblies from flowing back again. The overflow grid 12 is arranged for filtering and buffering the medium entering through the overflow pipe 11. A narrow-neck channel 16 is arranged in the overflow pipe 11 to prevent a large amount of medium from flowing back through the overflow pipe 11 into the tank. The plunger seat 6 is configured to fix one end of the plunger spring 7, the plunger sleeve 8 is sealed with the plunger ball 9, and the plunger sleeve 8 is fixed in the plunger pipe 5 by thread sealing. The plunger pipe 5 and the oil filling channel 19 may be arranged in multiple groups, not limited to two groups, as required. The medium in the technology is generally oil. In the present technology, when the electromagnetic assembly does not operate, the balance disk 3 moves towards a side of the pump cover 2 under the action of the jacking spring 4, the volume between the balance disk 3 and the bottom of the pump cavity 13 becomes larger to form a negative pressure, and both the pressure control assembly and the anti-backflow assemblies are in an inoperative state, and at this moment, the medium enters the pump cavity 13 from the overflow pipe 11 through the overflow grid 12 and the narrow-neck channel 16 in sequence; and at the same time, the plunger pipes 5 move together with the balance disk 3, and a volume of a pressure-variable cavity between the plunger pipe 5 and the anti-backflow control pipe 29 becomes larger to form a negative pressure. While the pressure of the medium between the balance disk 3 and the pump cover 2 increases and acts on the plunger balls 9; and under the double actions, the plunger balls 9 compress the plunger springs 7 to shorten under the pressure. The medium between the balance disk 3 and the pump cover 2 flows in from the first through-hole on the plunger sleeve 8, and then flows from the plunger balls 9 and the plunger pipes 5. After entering the pressure-variable cavity through the second through-hole, the medium does not continue to move when the balance disk 3 is in contact with the pump cover 2, and then the electromagnetic assembly starts to operate. The balance disk 3 moves towards sides of the anti-backflow assemblies under the action of the jacking spring 4, and less medium is discharged from the overflow pipe 11 under the action of the narrow-neck channel 16. The pressure control assembly will open until the preset value is reached; the plunger sleeve 8 and the plunger ball 9 are hermetically fitted at once; the medium between the balance disk 3 and the bottom of the pump cavity 13 enters between the balance disk 3 and the pump cover 2 through the balance channels 18; and at the same time, the volume of the pressure-variable cavity becomes smaller, and the pressure of the medium increases, so that the anti-backflow assemblies are opened, and the medium enters the use equipment through the anti-backflow assemblies. When the balance disk 3 is in contact with the lug boss 17, the electromagnetic assembly does not operate, and then the balance disk 3 moves towards the side of the pump cover 2 under the action of the jacking spring 4 to start a new round of operation.

In some examples, a guide rod 21 is fixedly arranged at a middle part of the balance disk 3, one end of the guide rod 21 is arranged in the first blind hole and cooperates with the first blind hole, an end portion of the guide rod 21 is arranged with a second blind hole, an end portion of the jacking spring 4 is arranged in the second blind hole, several pressure relief holes 22 penetrate through and are arranged on a side wall of a bottom of the second blind hole, and the other end of the guide rod 21 is fixedly connected to the electromagnetic assembly. A wear-resistant bushing 23 is arranged between an inner wall of the first blind hole and an outer wall of the guide rod 21. The balance disk 3 is a layer of plate, the guiding function of the balance disk 3 is relatively poor during the movement, and the guide rod 21 is arranged so that the balance disk 3 can only slide along an axial center line direction of the guide rod 21. Since the jacking spring 4 is needed to drive the balance disk 3 for resetting, a second blind hole is arranged on the guide rod 21 for mounting the jacking spring 4, and in order to prevent a high-pressure sealing cavity from being formed between the first blind hole and the second blind hole, the pressure relief holes 22 are arranged for pressure relief. The balance disk 3 causes friction to the guide rod 21 during frequent reciprocating movements, and therefore, the arrangement of the wear-resistant bushing 23 allows the plunger pump to have a longer service life.

In some examples, the pressure control assembly includes a pressure control pipe 25, a pressure spring 26, a pressure end head 27 and a first adjusting inner sleeve 28; one end of the pressure control pipe 25 is hermetically and fixedly connected to the outlet port 15, and a first stepped hole penetrates through and is arranged in the pressure control pipe 25; one end of the pressure spring 26 is fixedly arranged at a bottom of the first stepped hole, and the other end of the pressure spring 26 is pressed against and slidably arranged on the pressure end head 27 in the first stepped hole; and the pressure end head 27 is hermetically fitted with an end portion of the first adjusting inner sleeve 28, the first adjusting inner sleeve 28 is hermetically and fixedly arranged on an inner wall of the first stepped hole and is arranged close to a side of the outlet port 15, and a first adjusting hole penetrates through and is arranged in the first adjusting inner sleeve 28. An input end of the pressure control pipe 25 is threadedly and hermetically fitted with the outlet port 15; when the pressure in the pump cavity 13 exceeds a preset value, the hydraulic pressure in the pump cavity 13 passes through the pressure end head 27 to compress the pressure spring 26; and after the pressure spring 26 is compressed, the medium in the pump cavity 13 passes through the gap between the pressure end head 27 and the pressure control pipe 25 and is discharged from the output end of the pressure control pipe 25. Generally, the medium discharged from the pressure control pipe 25 is returned to the oil tank; and when the pressure of the medium in the pump cavity 13 decreases below the preset value, under the action of the pressure spring 26, the pressure end head 27 is sealed with the first adjusting inner sleeve 28. The first adjusting inner sleeve 28 is arranged for facilitating the mounting of the pressure spring 26 and the pressure end head 27; and the first adjusting inner sleeve 28 is threadedly and hermetically fitted with the pressure control pipe 25.

In some examples, the anti-backflow assemblies include anti-backflow control pipes 29, anti-backflow springs 30, anti-backflow end heads 31 and second adjusting inner sleeves 32; one end of the anti-backflow control pipe 29 is hermetically and fixedly connected to the oil filling channel 19, and a second stepped hole penetrates through and is arranged in the anti-backflow control pipe 29; one end of the anti-backflow spring 30 is fixedly arranged at a bottom of the second stepped hole, and the other end of the anti-backflow spring 30 is pressed against and slidably arranged on the anti-backflow end head 31 in the second stepped hole; and the anti-backflow end head 31 is hermetically fitted with an end portion of the second adjusting inner sleeve 32, the second adjusting inner sleeve 32 is hermetically and fixedly arranged on an inner wall of the second stepped hole and is arranged close to a side of the oil filling channel 19, and a second adjusting hole penetrates through and is arranged in the second adjusting inner sleeve 32. An input end of the anti-backflow control pipe 29 is hermetically and threadedly connected to the outlet of the oil filling channel 19, and the output end of the anti-backflow control pipe 29 enters the use equipment through a high-pressure oil pipe. In the oil filling channel 19, the anti-backflow control pipe 29 and the plunger pipe 5 form a pressure-variable cavity; when the pressure of the medium in the pressure-variable cavity is greater than the pressure given by the anti-backflow spring 30, the medium in the pressure-variable cavity pushes the anti-backflow end head 31 to compress the anti-backflow spring 30; after the anti-backflow spring 30 is compressed, the medium in the pressure-variable cavity enters an output end of the anti-backflow control pipe 29 through the gap between the anti-backflow end head 31 and the anti-backflow control pipe 29; and after the pressure of the medium in the pressure-variable cavity is reduced, under the action of the anti-backflow spring 30, the second adjusting inner sleeve 32 is sealed with the anti-backflow end head 31, and the second adjusting inner sleeve 32 is arranged for hermetically and threadedly fitting an outer wall of the second adjusting inner sleeve 32 and an inner wall of the anti-backflow control pipe 29 when the anti-backflow end head 31 and the anti-backflow spring 30 are mounted.

In some examples, the electromagnetic assembly includes a coil 34, an iron core 35, a push rod 36 and a reset spring 37; and the pump cover 2 is hermetically arranged with a movable cavity 38, the coil 34 is fixedly arranged on an inner wall of the movable cavity 38, the iron core 35 is slidably arranged in the coil 34, one end of the iron core 35 is fixedly connected to an end portion of the guide rod 21 via the push rod 36, and the iron core 35 is fixedly connected to the inner wall of the movable cavity 38 via the reset spring 37. In the solution, the elastic force of the reset spring 37 is less than that of the jacking spring 4; and the coil 34 drives the iron core 35 to move towards the side of the jacking spring 4 after electrifying, and the iron core 35 compresses the reset spring 37 under the action of the jacking spring 4 after power failure. The movable cavity 38, belonging to a sealed cavity, is communicated with the pump cavity 13, and the medium in the pump cavity 13 can enter the movable cavity 38 to cool the coil 34. One end of the push rod 36 is fixedly connected to the iron core 35, the other end of the push rod 36 is connected to the guide rod 21, and the iron core 35 drives the guide rod 21 to move via the push rod 36.

In some examples, cross sections of the inlet port 14 and the outlet port 15 are circular and coaxially arranged, and a cross section of the guide rod 21 is circular; and an axial center line of the inlet port 14 intersects an axial center line of the guide rod 21, the two oil filling channels 19 are symmetrically arranged at two sides of the lug boss 17, and the plane where axial center lines of the two oil filling channels 19 lie is perpendicular to the axial center line of the inlet port 14. An axial center line of the guide rod 21, a center line of the push rod 36, a center line of the jacking spring 4 and a center line of the reset spring 37 are in the same straight line. The inlet port 14 and the outlet port 15 are symmetrically arranged on two sides of the lug boss 17, and at the same time, two oil filling channels 19 are also symmetrically arranged on the lug boss 17, and the plane where the two oil filling channels 19 are located is perpendicular to the straight line where the inlet port 14 and the outlet port 15 are located; and this arrangement has the advantage of making the pressure received in the pump cavity 13 smoother. The guide rod 21, the push rod 36, the jacking spring 4 and the reset spring 37 are arranged in the same straight line, so that the balance disk 3 is only stressed in the moving direction, and is not stressed in other directions, facilitating the movement of the balance disk 3.

In the description of the present disclosure, it is to be understood that the orientation or positional relationship indicated by the terms "coaxial", "bottom", "one end", "top", "middle", "other end", "upper", "one side", "inner", "front", "center" and "two ends" is based on that shown in the attached drawings and merely for the ease of describing the present disclosure and simplifying the description, rather than indicating or implying that the device or element referred to must be in a specific orientation, and constructed and operated in a specific orientation. Therefore, it is not to be understood as a limitation of the present disclosure.

In the present disclosure, unless expressly stated or limited otherwise, the terms "mounted", "arranged", "connected", "fixed", and "hinged" are to be understood in a broad sense, for example, "connected" may be fixedly connected, detachably connected, integrally connected, mechanically connected, electrically connected, directly connected or indirectly connected through an intermediate medium, or an internal communication between two elements or the interaction between two elements. For those skilled in the art, the specific meanings of the above terms in the present disclosure can be understood according to specific situations, unless explicitly limited otherwise.

The foregoing is only the preferred example of the present disclosure, and it is to be understood that the present disclosure is not limited to the form disclosed herein, and is not to be regarded as the exclusion of other examples, but can be used in various other combinations, modifications and environments, and can be modified through the above teachings or the technology or knowledge in the related fields within the scope of the concepts described herein. However, modifications and changes made by those skilled in the art are to be within the scope of protection of the appended claims without departing from the spirit and scope of the present disclosure.

The invention claimed is:

1. A low-flow and double-outlet electromagnetic plunger pump, comprising a pump body (1), a pump cover (2), a balance disk (3), a jacking spring (4), plunger pipes (5), plunger seats (6), plunger springs (7), plunger sleeves (8), plunger balls (9), plunger seal rings (10), an overflow pipe (11), an overflow grid (12), an electromagnetic assembly, a pressure control assembly and anti-backflow assemblies, wherein a pump cavity (13) is arranged in the pump body (1), the pump cover (2) is fixedly arranged on the pump body (1) and is hermetically fitted with the pump cavity (13), and an inlet port (14) and an outlet port (15) penetrate through and are arranged on a side wall of the pump cavity (13); the inlet port (14) is arranged opposite to the outlet port (15), the pressure control assembly is hermetically and fixedly arranged on the outlet port (15), and an end portion of the overflow pipe (11) is hermetically and fixedly arranged on the inlet port (14); an interior of the overflow pipe (11) is hermetically and fixedly arranged with an overflow grid (12), the interior of the overflow pipe (11) is arranged with a narrow-neck channel (16), and the narrow-neck channel (16) is arranged between the overflow grid (12) and the pump cavity (13); the balance disk (3) is slidably arranged in the pump cavity (13) and cooperates with an inner wall of the pump cavity (13), the electromagnetic assembly is hermetically and fixedly arranged on the pump cover (2) and is configured to drive the balance disk (3) to slide, a lug boss (17) cooperating with an end surface of the balance disk (3) is hermetically and fixedly arranged at a middle position of a bottom of the pump cavity (13), and a first blind hole is arranged on the lug boss (17); one end of the jacking spring (4) is arranged in the first blind hole, the other end of the jacking spring (4) is in contact with the balance disk (3), several balance channels (18) penetrate through and are arranged on the balance disk (3), and two oil filling channels (19) parallel to a moving direction of the balance disk (3) are arranged on the bottom of the pump cavity (13); the anti-backflow assemblies are hermetically and fixedly arranged on outlets of the oil filling channels (19), one end of the plunger pipe (5) is slidably arranged in the oil filling channel (19) and cooperates with the oil filling channel (19), and the plunger seal rings (10) are arranged between an inner wall of the oil filling channel (19) and an outer wall of the plunger pipe (5); the other end of the plunger pipe (5) is fixedly arranged in the balance disk (3), and an oil passing channel (20) is arranged in the plunger pipe (5); one end of the oil passing channel (20) is communicated with the oil filling channel (19), the other end of the oil passing channel (20) is communicated with the pump cavity (13), and the plunger seat (6) is fixedly arranged in the oil passing channel (20); one end of the plunger spring (7) is arranged on the plunger seat (6), and the other end of the plunger spring (7) is in contact with the plunger ball (9) slidably arranged in the oil passing channel (20); and the plunger ball (9) is hermetically fitted with an end portion of the plunger sleeve (8), the plunger sleeve (8) is hermetically and fixedly arranged on an inner wall of the oil passing channel (20) and is arranged close to a side of the pump cavity (13), a first through-hole penetrates through and is arranged in the plunger sleeve (8), and a second through-hole penetrates through and is arranged on the plunger seat (6).

2. The low-flow and double-outlet electromagnetic plunger pump according to claim 1, wherein a guide rod (21) is fixedly arranged at a middle part of the balance disk (3), one end of the guide rod (21) is arranged in the first blind hole and cooperates with the first blind hole, an end portion of the guide rod (21) is arranged with a second blind hole, an end portion of the jacking spring (4) is arranged in the second blind hole, several pressure relief holes (22) penetrate through and are arranged on a side wall of a bottom of the second blind hole, and the other end of the guide rod (21) is fixedly connected to the electromagnetic assembly.

3. The low-flow and double-outlet electromagnetic plunger pump according to claim 2, wherein a wear-resistant bushing (23) is arranged between an inner wall of the first blind hole and an outer wall of the guide rod (21).

4. The low-flow and double-outlet electromagnetic plunger pump according to claim 2, wherein the electromagnetic assembly comprises a coil (34), an iron core (35), a push rod (36) and a reset spring (37); and the pump cover (2) is hermetically arranged with a movable cavity (38), the coil (34) is fixedly arranged on an inner wall of the movable cavity (38), the iron core (35) is slidably arranged in the coil (34), one end of the iron core (35) is fixedly connected to an end portion of the guide rod (21) via the push rod (36), and the iron core (35) is fixedly connected to the inner wall of the movable cavity (38) via the reset spring (37).

5. The low-flow and double-outlet electromagnetic plunger pump according to claim 4, wherein cross sections of the inlet port (14) and the outlet port (15) are circular and coaxially arranged, and a cross section of the guide rod (21) is circular; and an axial center line of the inlet port (14) intersects an axial center line of the guide rod (21), the two oil filling channels (19) are symmetrically arranged at two sides of the lug boss (17), and the plane where axial center lines of the two oil filling channels (19) lie is perpendicular to the axial center line of the inlet port (14).

6. The low-flow and double-outlet electromagnetic plunger pump according to claim 5, wherein the axial center line of the guide rod (21), a center line of the push rod (36), a center line of the jacking spring (4) and a center line of the reset spring (37) are in the same straight line.

7. The low-flow and double-outlet electromagnetic plunger pump according to claim 1, wherein the plunger seal rings (10) are fixed on the oil filling channel (19) via a pressing plate (24).

8. The low-flow and double-outlet electromagnetic plunger pump according to claim 1, wherein the pressure control assembly comprises a pressure control pipe (25), a pressure spring (26), a pressure end head (27) and a first adjusting inner sleeve (28); one end of the pressure control pipe (25) is hermetically and fixedly connected to the outlet port (15), and a first stepped hole penetrates through and is arranged in the pressure control pipe (25); one end of the pressure spring (26) is fixedly arranged at a bottom of the first stepped hole, and the other end of the pressure spring (26) is pressed against and slidably arranged on the pressure end head (27) in the first stepped hole; and the pressure end head (27) is hermetically fitted with an end portion of the first adjusting inner sleeve (28), the first adjusting inner sleeve (28) is hermetically and fixedly arranged on an inner wall of the first stepped hole and is arranged close to a side of the outlet port (15), and a first adjusting hole penetrates through and is arranged in the first adjusting inner sleeve (28).

9. The low-flow and double-outlet electromagnetic plunger pump according to claim 1, wherein the anti-backflow assemblies comprise anti-backflow control pipes (29), anti-backflow springs (30), anti-backflow end heads (31) and second adjusting inner sleeves (32); one end of the anti-backflow control pipe (29) is hermetically and fixedly connected to the oil filling channel (19), and a second stepped hole penetrates through and is arranged in the anti-backflow control pipe (29); one end of the anti-backflow spring (30) is fixedly arranged at a bottom of the second stepped hole, and the other end of the anti-backflow spring (30) is pressed against and slidably arranged on the anti-backflow end head (31) in the second stepped hole; and the anti-backflow end head (31) is hermetically fitted with an end portion of the second adjusting inner sleeve (32), the second adjusting inner sleeve (32) is hermetically and fixedly arranged on an inner wall of the second stepped hole and is arranged close to a side of the oil filling channel (19), and a second adjusting hole penetrates through and is arranged in the second adjusting inner sleeve (32).

10. The low-flow and double-outlet electromagnetic plunger pump according to claim 1, wherein pump seal rings (33) are arranged between the pump body (1) and the pump cover (2) and arranged at an outer side of the pump cavity (13).

* * * * *